US006761149B2

(12) United States Patent
Frank

(10) Patent No.: US 6,761,149 B2
(45) Date of Patent: Jul. 13, 2004

(54) HIGH-PRESSURE FUEL ACCUMULATOR

(75) Inventor: Kurt Frank, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 72 days.

(21) Appl. No.: 10/213,737

(22) Filed: Aug. 7, 2002

(65) Prior Publication Data

US 2003/0047168 A1 Mar. 13, 2003

(30) Foreign Application Priority Data

Aug. 7, 2001 (DE) ..... 101 38 756

(51) Int. Cl.[7] ..... F02M 55/02
(52) U.S. Cl. ..... 123/456; 123/468; 123/458
(58) Field of Search ..... 123/456, 468, 123/469, 457, 458

(56) References Cited

U.S. PATENT DOCUMENTS 3,827,409 A * 8/1974 O'neill ..... 123/458
5,094,211 A * 3/1992 Mahnke et al. ..... 123/456
5,105,787 A * 4/1992 Imoehl ..... 123/469
6,223,726 B1 5/2001 Jung et al.
6,325,048 B1 * 12/2001 Robinson ..... 123/463

* cited by examiner

*Primary Examiner*—Thomas N. Moulis
(74) *Attorney, Agent, or Firm*—Kenyon & Kenyon

(57) ABSTRACT

A high-pressure fuel accumulator for a fuel injection system of an internal combustion engine, in particular for a common-rail fuel injection system, has an elongated base body having an accumulator space for high-pressure fuel extending in the longitudinal direction of the base body, communicating with multiple connecting bores. A relief space connected to a low-pressure connection is provided in the base body, with a drain channel from the accumulator space opening into it. A pressure regulating valve is installed in the base body for opening and closing the drain channel.

11 Claims, 2 Drawing Sheets

HIGH-PRESSURE FUEL ACCUMULATOR

FIELD OF THE INVENTION

The present invention relates to a high-pressure fuel accumulator for a fuel injection system of an internal combustion engine, in particular for a common-rail system.

BACKGROUND INFORMATION

In a common-rail injection system, a high-pressure pump conveys the fuel to be injected from a tank into a central high-pressure fuel accumulator, which is known as a common rail. High-pressure lines lead from the high-pressure fuel accumulator to the individual injectors associated with the cylinders of the internal combustion engine. The injectors are controlled individually by the engine electronic system as a function of the operating parameters of the internal combustion engine to inject fuel into the combustion chamber of the internal combustion engine. The base body of the high-pressure fuel accumulator is made of a forged blank, for example, with the interior of the base body being introduced as a longitudinal bore into the base body. The base body manufactured in this way is then provided with connecting bores which open into the longitudinal bore. Such a high-pressure fuel accumulator is known from German Published Patent Application No. 196 40 480 A1 (corresponding to U.S. Pat. No. 6,223,726), for example. To adjust the pressure in the high-pressure fuel accumulator as a function of the load state of the engine, a pressure regulating valve is used in the related art; this valve has its own housing part and is connected either to the high-pressure pump or is screwed onto an end connection of the high-pressure fuel accumulator by using screwable fastening means.

One disadvantage of the known high-pressure fuel accumulators is that because of the high pressure in the accumulator space, the sealing sites in the connection area of high-pressure fuel accumulators and pressure regulating valves may need to be manufactured with high precision, and multiple sealing elements may be necessary for the seal. In addition, problems occur at the valve seat of the pressure regulating valve, because the valve seat is under high thermal stress due to the high-pressure fuel flowing out of the high-pressure fuel accumulator, which has a negative effect on the pressure regulation of the accumulator space. When the pressure regulating valve is screwed onto the base body of the high-pressure fuel accumulator, mechanical stresses occur in the base body and may lead to cracking and fracturing of the material in the area of intersections of connecting bores and the accumulator space in operation of the fuel injection system.

SUMMARY OF THE INVENTION

The high-pressure fuel accumulator according to an exemplary embodiment of the present invention avoids the disadvantages known in the related art. Due to the fact that a pressure regulating valve installed in the base body of the high-pressure fuel accumulator is provided, a separate housing part for the pressure regulating valve may be eliminated, thus reducing manufacturing costs for the entire system. Due to the installation of a pressure regulating valve in the base body of the high-pressure fuel accumulator, the complex seals on the pressure regulating valve used in the related art may be unnecessary. Since no screw connections are used in installing the pressure regulating valve in the base body of the high-pressure fuel accumulator, this may reduce material stresses in the transition area between the connecting bores and the accumulator space of the high-pressure fuel accumulator. Therefore, the pressure regulating valve may also be arranged in spatial proximity to the connecting bores, thereby reducing the installation space in the longitudinal direction of the base body. Due to the installation of the pressure regulating valve in the base body of the high-pressure fuel accumulator, thermal stabilization of the valve seat may also be achieved to advantage, because heat may be released from the valve seat to the metal base body.

The pressure regulating valve may be designed as a solenoid valve whose electromagnet is installed in a recess on the end face of the base body and sealed with a cover part.

In another exemplary embodiment, the base body may have a connection for supplying overflow fuel, this connection being connected to the relief space provided in the base body through an inlet line. The valve seat situated in the relief space may be cooled to advantage by supplying overflow fuel, which is at a lower temperature than the fuel in the accumulator space. The overflow fuel washed in through the inlet line flows out through the low-pressure connection together with the fuel flowing out of the accumulator space through the drain channel.

Another exemplary embodiment, in which the relief space, the drain channel from the accumulator space, and a section of a drain line connecting the relief space to the low-pressure connection are designed in a valve part which is inserted into a longitudinal bore in the base body to form the accumulator space and seals this longitudinal bore at one end, may be advantageous. Manufacture of the valve seat and the drain channel, which may contain a throttle, may be easier and less expensive to implement in the valve part. The base body may be provided with a longitudinal bore passing through at least one side. After manufacturing the valve part, it may then be inserted through the open end of the longitudinal bore into the latter and may be connected to the inside of the longitudinal bore with a seal.

DETAILED DESCRIPTION

Figure 1:
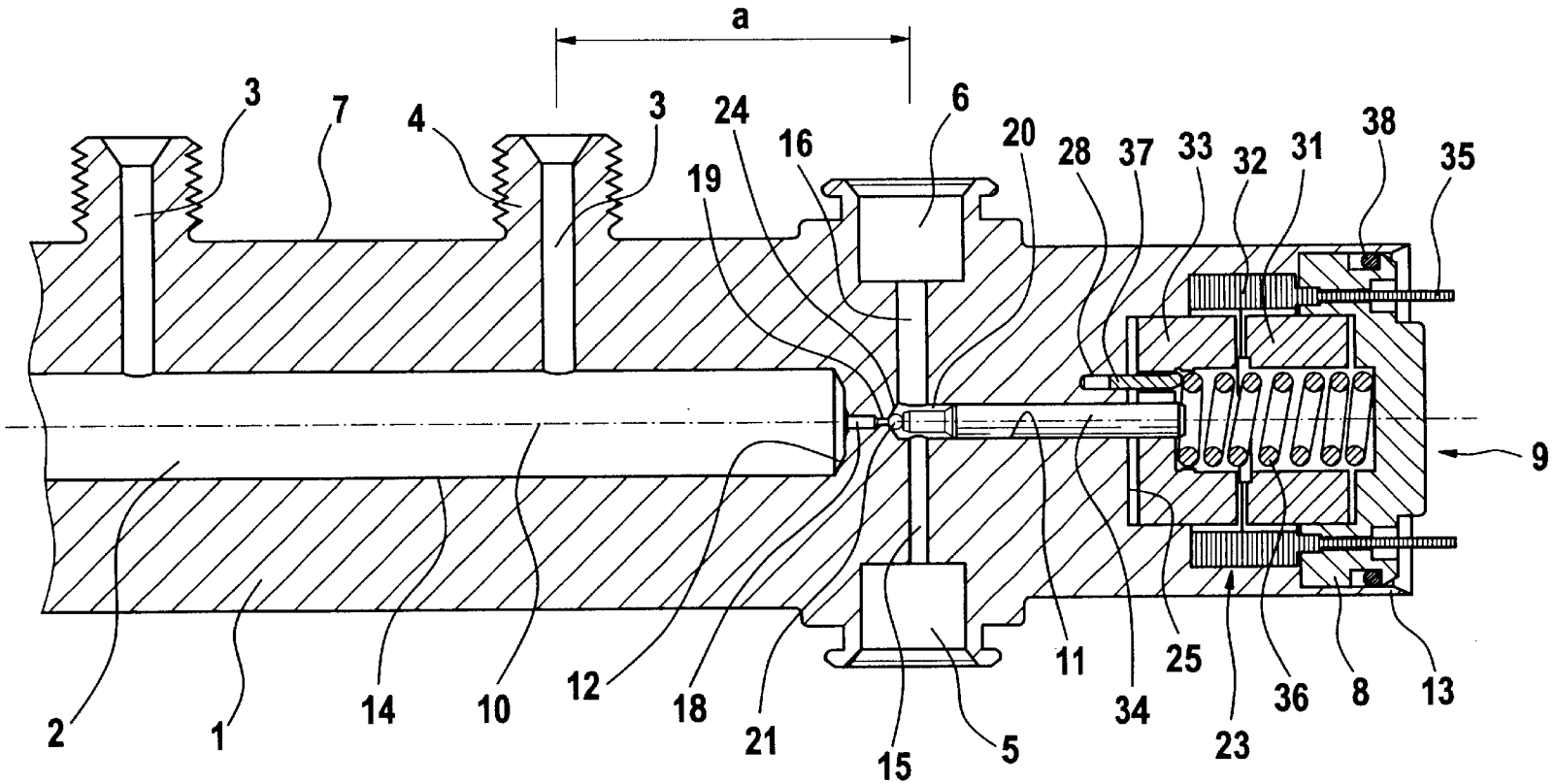
FIG. 1 shows a cross section through an end portion of a high-pressure fuel accumulator according to an exemplary embodiment of the present invention, which end portion is equipped with a pressure regulating valve.

FIG. 1 shows a cross section through a high-pressure fuel accumulator having an elongated tubular base body 1 made of metal in which an accumulator space 2 is provided. In the exemplary embodiment illustrated here, accumulator space 2 is formed by a blind hole 14 having central axis 10, its internal cross section being a circular area. However, the cross section of accumulator space 2 of base body 1 may also be other than circular, e.g., elliptical. Accumulator space 2 is connected to the outlet of a high-pressure pump by a high-pressure line, for example. The high-pressure connection for this may be provided on the end of accumulator space 2. On its outer jacket 7, base body 1 is provided with multiple connection fittings 4, one connecting bore 3 leading from each into accumulator space 2. Connection fittings 4 are provided with an external thread and are used for connecting high-pressure lines which lead to the injectors of the common-rail system. During operation, fuel from accumulator space 2 of the high-pressure fuel accumulator is distributed among the injectors of the common-rail system through connecting bores 3.

As FIG. 1 also shows, a drain channel 18 having a throttle 19 branches off from accumulator space 2 coaxially with central axis 10 of blind hole 14 at one end 12 of blind hole 14 forming accumulator space 2, opening centrally into a valve seat 24. Valve seat 24 is situated in a relief space 20 which is connected by a drain line 15, designed as a bore, to a low-pressure connection 5 in base body 1. Valve seat 24, drain channel 18 and relief space 20 are provided in base body 1 in this exemplary embodiment. An overflow connection 6 is connected to relief space 20 through an inlet line 16 in the form of a bore. Inlet line 16 and drain line 15 branch off radially to central axis 10 of accumulator space 2 and drain channel 18. Relief space 20 is connected to a pot-shaped recess 25 on end face 9 of base body 1 by a bore 11 running coaxially with central axis 10. Holding-down bolt 34 mounted slidably displaceably in bore 11 acts with its end inserted into relief space 20 on a valve element 21 designed in the form of a ball. An electromagnet having a coil 32, a magnet core 31 and armature plate 33 is inserted into recess 25 in base body 1. Recess 25 is sealed with a cover part 8. A peripheral collar 13 on the end of base body 1 forms a flange around cover part 8. A sealing ring 38 seals the transition area between the inside wall of recess 25 and the outside edge of cover part 8. Connections 35 of coil 32 project from end face 9 of base body 1 through sealed recesses in cover part 8. As FIG. 1 also shows, holding-down bolt 34 also projects from armature plate 33 to relief space 20.

Armature plate 33 and holding-down bolt 34 connected to it are constantly acted upon by a valve spring 36 supported on cover part 8, so that when the electromagnet is turned off, holding-down bolt 34 presses valve element 21 into valve seat 24, and drain channel 18 is closed. If the pressure in accumulator space 2 is to be reduced, the electromagnet is acted upon by a voltage, so that armature plate 33 with holding-down bolt 34 is moved to the right in FIG. 1 against the tension of valve spring 36, and drain channel 18 is opened. Fuel flowing out of drain channel 18 through throttle 19 enters relief space 20 and goes from there through drain line 15 to low-pressure connection 5 of the high-pressure fuel accumulator. When the electromagnet is turned off, control valve element 21 is pressed into valve seat 24 by the tension of valve spring 36, and drain channel 18 is closed again.

As shown in FIG. 1, overflow fuel which is at a lower temperature than the fuel in accumulator space 2 may be washed through connection 6 into relief space 20 for cooling purposes and for thermal stabilization of valve seat 24. As also shown in FIG. 1, distance "a" of the valve seat from the next connecting bore 3 may be kept very small because, due to installation of the pressure regulating valve in base body 1, as shown here, stresses may be advantageously prevented from being transferred to the intersection in the transitional area between connecting bores 3 and accumulator space 2.

In an alternative exemplary embodiment, instead of the electromagnet, a piezoelectric actuator or some other suitable actuator device may also be used to operate the valve element.

Figure 2:
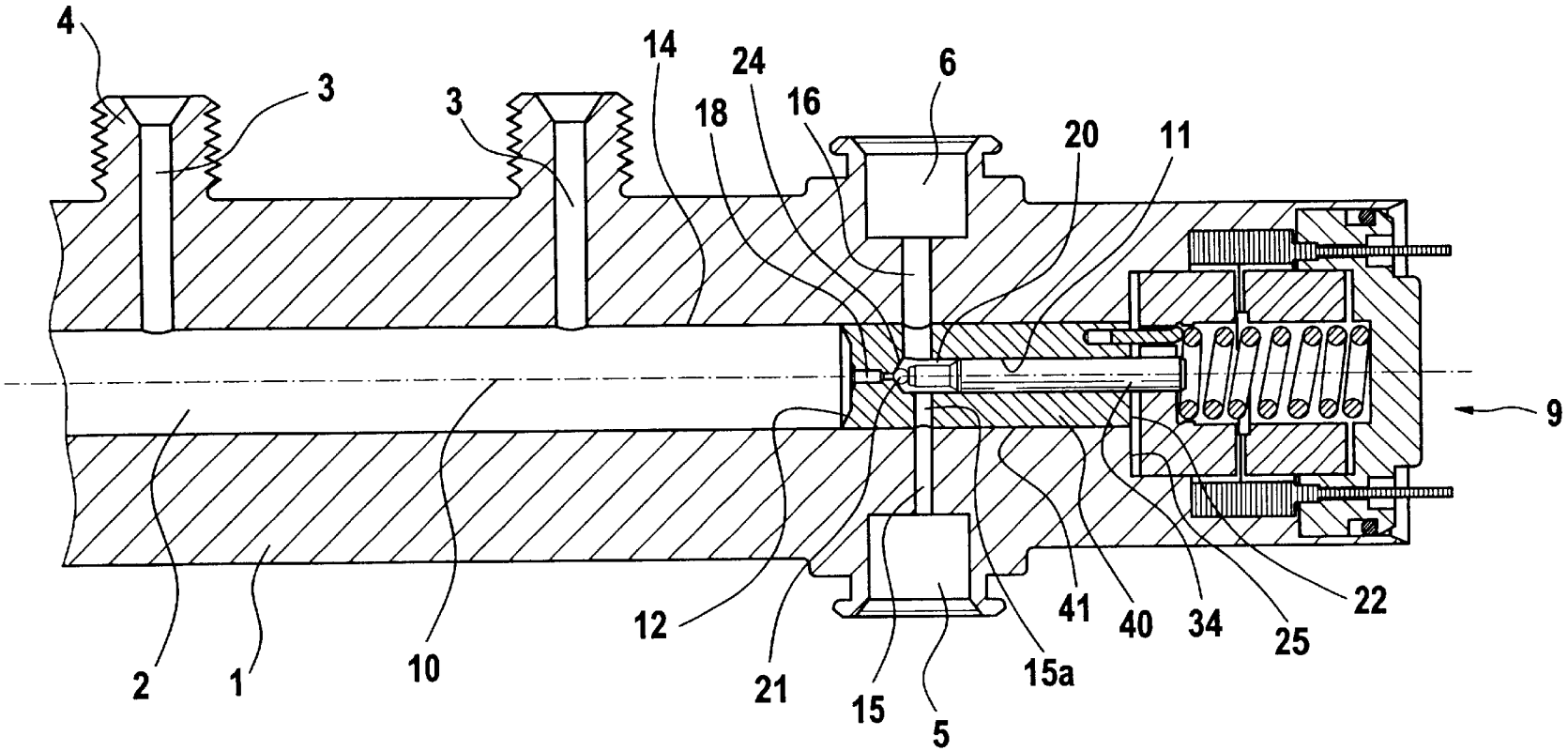
FIG. 2 shows a cross section through another exemplary embodiment of the present invention.

FIG. 2 illustrates another exemplary embodiment in which longitudinal bore 14 is designed as a through-hole running toward recess 25 on end face 9 of base body 1. Optionally, however, a blind hole may also be introduced into base body 1 from end face 9 of base body 1 shown in FIG. 2. In addition, recess 25 may have the same inside radius as bore 14, which may simplify machining. As shown in FIG. 2, a valve part 40 is inserted into longitudinal bore 14 from end face 9 of base body 1 and seals the end of the longitudinal bore. The valve part is cylindrical with a central bore 11 connecting an end face 22 of the valve part to a relief space 20 in the interior of valve part 40. Relief space 20 is connected to second end face 12 of valve part 40 facing accumulator space 2 via a drain channel 18 which is coaxial with bore 11 and has throttle 19. Radially to the axis of bore 11 and therefore also radially to the axis of longitudinal bore 14, connecting bores 15*a*, 16*a*, which are aligned with bores 15, 16 in base body 1, branch off from the valve part. Valve part 40 having valve seat 24, drain channel 18 and throttle 19 outside of base body 1 may be made to advantage of a material having high temperature stability, preferably a metal, and then inserted into base body 1. Outer jacket 41 of the valve part may be connected tightly to the inside wall of longitudinal bore 14 by welding, soldering, press-fitting or other suitable techniques, for example.

As shown in FIG. 1 and FIG. 2, a centering pin 37 may additionally be provided in accordance with the present invention, e.g., a bent-over end of valve spring 36, which is passed through a recess in armature plate 33 and engages in a bore 28 at the base of recess 25 or in a bore on end face 22 of valve part 40. Centering pin 37 is used as anti-rotation protection for armature plate 33.

What is claimed is:

1. A high-pressure fuel accumulator for a fuel injection system of an internal combustion engine, comprising:

an elongated base body, the elongated base body including:

an accumulator space for high-pressure fuel extending in a longitudinal direction of the elongated base body, the accumulator space communicating with a plurality of connecting bores, a relief space connected to a low-pressure connection, and a drain channel from the accumulator space opening into the relief space; and a pressure regulating valve installed in the elongated base body for opening and closing the drain channel;

wherein the pressure regulating valve includes: a valve element, a valve seat and an actuating device operable to act upon the valve element; and wherein the valve element cooperates with the valve seat, and the drain channel from the accumulator space opens into the valve seat.

2. A high-pressure fuel accumulator for a fuel injection system of an internal combustion engine, comprising:

an elongated base body, the elongated base body including:

an accumulator space for high-pressure fuel extending in a longitudinal direction of the elongated base body, the accumulator space communicating with a plurality of connecting bores, a relief space connected to a low-pressure connection, and a drain channel from the accumulator space opening into the relief space; and a pressure regulating valve installed in the elongated base body for opening and closing the drain channel;

wherein:

the accumulator space is formed by an approximately cylindrical recess in the elongated base body; and the drain channel branches off from a first end of the approximately cylindrical recess in parallel with a central axis of the approximately cylindrical recess.

3. The high-pressure fuel accumulator as recited in claim 2, further comprising a drain line, wherein the drain line is connected to the low-pressure connection and branches off from the relief space radially to the central axis.

4. The high-pressure fuel accumulator as recited in claim 1, wherein the actuating device includes:

an electromagnet including solenoids; and a magnet armature operable to be acted upon by a valve spring, wherein the magnet armature is in turn operable to act upon the valve element.

5. The high-pressure fuel accumulator as recited in claim 4, wherein the magnet armature includes an armature plate and a holding-down bolt slidably and displaceably mounted in a bore communicating with the relief space, and wherein an end of the holding-down bolt faces away from the solenoids, which solenoids are operable to act upon the valve element.

6. The high-pressure fuel accumulator as recited in claim 4, wherein the electromagnet is insertable with the armature plate into a receptacle on an end face of the elongated base body, and wherein the receptacle is sealed with a cover part.

7. A high-pressure fuel accumulator for a fuel injection system of an internal combustion engine, comprising:

an elongated base body, the elongated base body including:

an accumulator space for high-pressure fuel extending in a longitudinal direction of the elongated base body, the accumulator space communicating with a plurality of connecting bores, a relief space connected to a low-pressure connection, and a drain channel from the accumulator space opening into the relief space; and a pressure regulating valve installed in the elongated base body for opening and closing the drain channel;

wherein the elongated base body includes a connection for supplying overflow fuel, the connection being connected by an inlet line to the relief space.

8. The high-pressure fuel accumulator as recited in claim 7, wherein:

the inlet line branches off from the relief space radially to a central axis of the accumulator space.

9. A high-pressure fuel accumulator for a fuel injection system of an internal combustion engine, comprising:

an elongated base body, the elongated base body including:

an accumulator space for high-pressure fuel extending in a longitudinal direction of the elongated base body, the accumulator space communicating with a plurality of connecting bores, a relief space connected to a low-pressure connection, and a drain channel from the accumulator space opening into the relief space; and a pressure regulating valve installed in the elongated base body for opening and closing the drain channel;

wherein:

the accumulator space is formed in the elongated base body by a longitudinal bore, the longitudinal bore being sealed at a first end by a valve part inserted into the longitudinal bore; and the valve part includes at least the drain channel, the relief space, and a section of a drain line connecting the relief space to the low-pressure connection.

10. The high-pressure fuel accumulator as recited in claim 9, wherein:

the valve part has an approximately cylindrical outer jacket sealingly connected to an inside wall of the longitudinal bore.

11. A high-pressure fuel accumulator for a fuel injection system of an internal combustion engine, comprising:

an elongated base body, the elongated base body including:

an accumulator space for high-pressure fuel extending in a longitudinal direction of the elongated base body, the accumulator space communicating with a plurality of connecting bores, a relief space connected to a low-pressure connection, and a drain channel from the accumulator space opening into the relief space; and a pressure regulating valve installed in the elongated base body for opening and closing the drain channel;

wherein the drain channel includes a throttle.

* * * * *